United States Patent [19]

Dutra, Jr.

[11] 4,136,793

[45] Jan. 30, 1979

[54] LOAD STABILIZER FOR FORKLIFT TRUCK

[76] Inventor: Joseph G. Dutra, Jr., 4568 Thornton Ave., Fremont, Calif. 94536

[21] Appl. No.: 790,702

[22] Filed: Apr. 25, 1977

[51] Int. Cl.[2] ..... B66F 9/18

[52] U.S. Cl. ..... 214/654; 214/653

[58] Field of Search ..... 214/650 R, 651, 652, 214/653, 654, 655, 620, 671, 371, 373, 377, 378, 379

[56] References Cited

U.S. PATENT DOCUMENTS

| | | | |
|---|---|---|---|
| 2,561,896 | 7/1951 | Weiss | 214/620 |
| 2,799,417 | 7/1957 | Morrell | 214/652 |
| 2,828,039 | 3/1958 | Puim | 214/654 |
| 2,832,489 | 4/1958 | Bailey | 214/620 |
| 3,773,202 | 11/1973 | Dutra | 214/654 |
| 3,797,684 | 3/1974 | Brandt | 214/620 X |
| 3,851,777 | 12/1974 | Dilny | 214/620 |

FOREIGN PATENT DOCUMENTS

| | | | |
|---|---|---|---|
| 132666 | 5/1949 | Australia | 214/654 |
| 532056 | 10/1956 | Canada | 214/654 |

*Primary Examiner*—Frank E. Werner

*Attorney, Agent, or Firm*—Warren, Chickering & Grunewald

[57] ABSTRACT

A load stabilizer for use with a forklift truck which includes a frame, top and side clamping mechanisms formed so that they may be clamped down on a load, for example boxes or the like, to hold the same in place while being carried by the forks of the forklift truck. The top and side clamps are gravity and spring biased to an unclamped position and are formed for displacement to a clamped position upon engagement of the top clamping mechanism with the load. The entire stabilizer can, while still mounted to the forklift, be positioned in a stored position for towing. The load stabilizer is hydraulically powered from the forklift truck hydraulic system and may optionally include hydraulic side clamping apparatus movable to a position enabling top clamping of wide loads.

11 Claims, 14 Drawing Figures

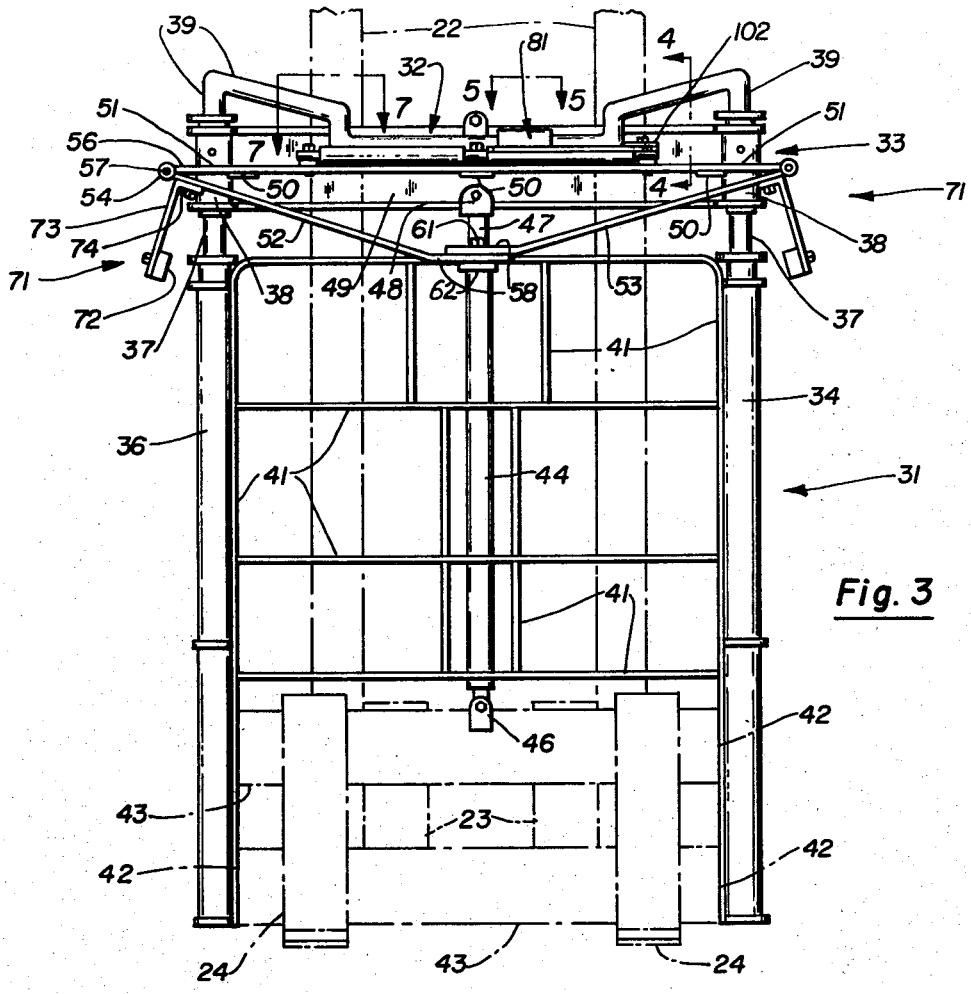
Fig. 3
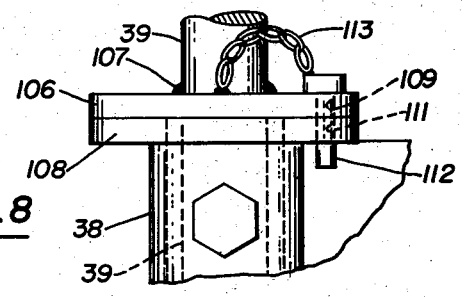
Fig. 8
Fig. 7
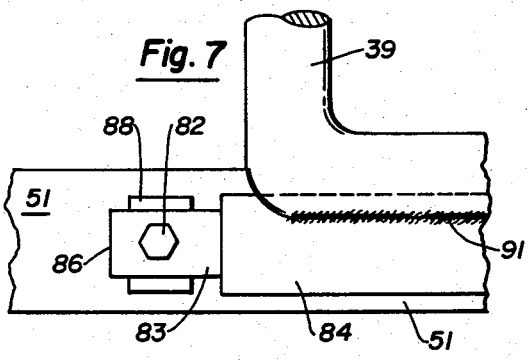
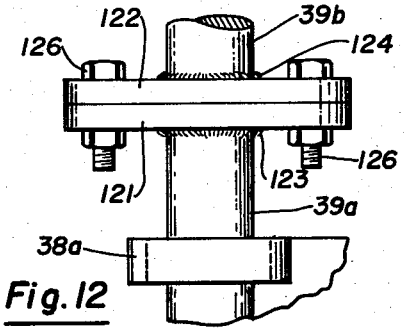
Fig. 12

LOAD STABILIZER FOR FORKLIFT TRUCK

BACKGROUND OF THE INVENTION

The use of load stabilizing devices or mechanisms in connection with forklift trucks, including lift trucks or hoist trucks, is well known. The load stabilizing apparatus is mounted in substantially superimposed relation over the forks or tines of the forklift truck, and the hydraulic system of the forklift truck is employed to operate a hydraulic piston and cylinder for vertical reciprocation of the stabilizer independently of vertical movement of the forks.

In operation, the load stabilizer is reciprocated to an upward position above the height of the load to be carried, and the tines of the truck are brought into position underneath the load, usually on a pallet. The stabilizer is then brought down into engagement with the top of the load so as to apply a clamping force to the same. Additionally, some load stabilizers include side clamping mechanisms which can be brought into engagement with the side of the load for further stabilization of the load as carried by the truck. The entire load may be lifted by the tines or forks, and the stabilizer will maintain the same clamping pressure on the load, regardless of the height to which the forks are lifted.

My prior U.S. Pat. No. 3,773,202 describes in detail an adjustable load stabilizer frame which may be advantageously employed to accommodate a very wide range of vertical height adjustments of the load stabilizer. In my prior patent a brief description of the load stabilizing clamping structure is set forth, although the details of construction of the clamping mechanism itself are incomplete, since they were not pertinent to the vertical adjustment apparatus of my prior invention.

In addition to the limited disclosure of my prior patent, the prior art includes load stabilizing mechanisms designed to engage and clamp the top of a single large container, such as the devices of U.S. Pat. Nos. 3,272,364 and 2,807,382. These devices are not well suited, for example, for gripping a plurality of small boxes, such as fruit or vegetable crates.

Some load stabilizers are simply formed as flat plates which can be brought into engagement with the top of a load, for example, the stabilizers U.S. Pat. Nos. 3,567,053 and 2,875,912, and the plate-like stabilizer set forth in the 1965 brochure of Little Giant Products Inc. for its LITTLE GIANT brand load stabilizer. This approach limits the degree to which the stabilizer can accommodate uneven top surfaces, usually to the depth of a foam pad or the like mounted on the plate or frame.

More complex forklift truck load stabilizing devices are shown in U.S. Pat. Nos. 3,133,655 and 3,024,929. These devices employ apparatus designed to engage the load at discrete, predetermined locations, which limits their use to specialized applications, again primarily to large boxes.

Perhaps the most versatile prior lift truck load stabilizing devices are those which employ a leaf spring top clamping structure. Typical of these devices are the stabilizer of U.S. Pat. No. 2,684,165 and the stabilizers described in the brochures of Equipment Sales Co. for its PHILIFT brand stabilizer and Edwards Equipment Company for its TRANS-FORK brand stabilizer. Even these devices, however, lack a side clamping capability, present a towing problem and are limited in the load configurations which they can accommodate.

Thus, various prior art load stabilizers are adequate if the forklift truck is used to carry only one kind of load, but when a stabilizer is to be used in general duty warehousing with loads of various configurations, such prior stabilizers have been found to have substantial disadvantages. They may not be able, for example, to accommodate load heights which vary across the length and width of the pallet. Often there is no provision for side clamping or adjustment of the width of the side clamping apparatus. Still further, some side clamping apparatus will not accommodate extremely wide loads. Moreover, there has been a problem with transport of load stabilizers when the forklift truck is being towed from site to site. Accordingly, the use of forklift truck load stabilizers has often been confined to specialized industries which have uniform and repetitive load configurations.

OBJECTS OF THE INVENTION

Accordingly, it is an object of the present invention to provide a load stabilizer mechanism which has improved versatility and flexibility and will accommodate a wide range of differing load configurations.

It is another object of the present invention to provide a load stabilizer which is formed in a manner which allows it to automatically adjust to differing load heights and load angles.

Still another object of the present invention is to provide a load stabilizer which may be used and provide side clamping on loads having differing widths.

Another object of the present invention is to provide a load stabilizer for a forklift truck which can be easily and conveniently stored for towing while still mounted to the forklift truck.

Still a further object of the present invention is to provide a load stabilizer for a forklift truck which is durable, requires little service, can be easily attached to virtually all models of forklift trucks, is easy to operate, and is relatively inexpensive of manufacture.

The forklift truck load stabilizer of the present invention has other objects and features of advantage which will become apparent from and are set forth in detail in the accompanying drawing and the following detailed description of the preferred embodiments.

SUMMARY OF THE INVENTION

The load stabilizer for forklift trucks includes a frame formed for mounting to the forklift and carrying, in cantilevered relation thereto, an upwardly displaceable, downwardly biased, top clamping means formed to engage the top surface of a load carried by the forklift. The improved stabilizer of the present invention comprises, briefly, a load stabilizer in which the top clamping means is gravity and spring biased to an unclamped position, and mounting means interconnecting the top clamping means to side clamping means for proportional automatic displacement of the side clamping means to a clamped position and for biasing of the side clamping means to an unclamped position. The top clamping means is advantageously provided by pairs of leaf spring members pivotally mounted to a frame portion at the outer ends of the spring leaf members and coupled for relative sliding movement at their inner ends, with the side clamping means mounted to the leaf springs proximate the pivotal mounts. The entire clamping structure is mounted for tilting, may optionally include a hydraulic side clamping structure, and is formed for selective positioning in a stored position over the body of the forklift truck for towing without removal of the stabilizer.

DESCRIPTION OF THE DRAWING

FIG. 3 is a slightly enlarged front elevational view of the load stabilizer of FIG. 1.

FIG. 7 is an enlarged, fragmentary, top plan view of the area bounded by the line 7—7 in FIG. 3.

FIG. 8 is an enlarged, fragmentary, side elevational view of a locking structure on a vertical post of the stabilizer of FIG. 1.

FIG. 12 is an enlarged, fragmentary, side elevational view of an alternative structure of a split vertical post for the stabilizer of FIG. 1.

DESCRIPTION OF THE PREFERRED EMBODIMENTS

Figure 1:
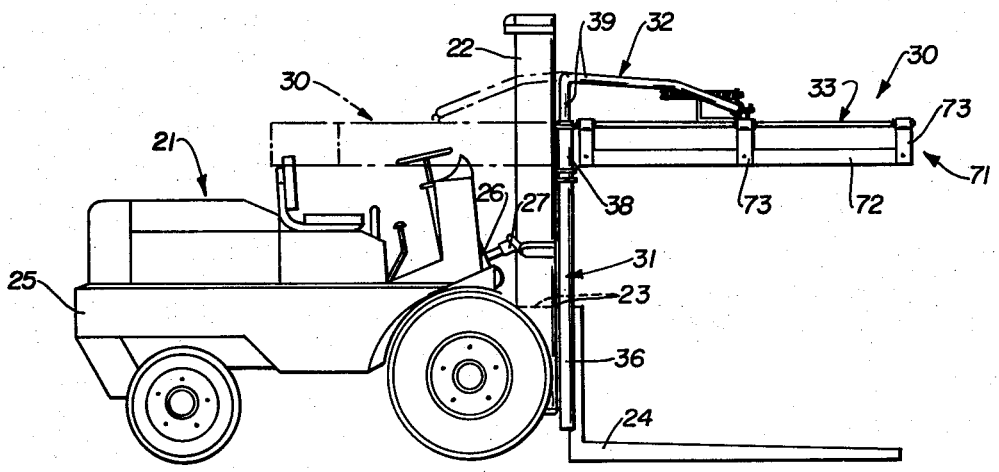
FIG. 1 is a side elevational view of a forklift truck having a load stabilizer mounted thereto constructed in accordance with the present invention.

As may be seen in FIG. 1, a forklift truck, generally designated 21, is shown which includes an upright lift frame or a mast 22 to which a movable carriage 23 is mounted for vertical reciprocation. Removably mounted for movement with carriage 23 are a pair of forklift forks or tines 24 formed for support and lifting of loads, usually mounted on a forklift pallet. Lift mast 22 is conveniently formed as a pair of opposed C-shaped channels with carriage 23 mounted therebetween on rolling elements guided by the mast. Carriage driving means (not shown), such as a hydraulic cylinder and piston, are provided to enable reciprocation of carriage 23 within mast 22. Additionally, mast 22 is mounted for articulation at its base to enable tilting of the same by means of hydraulic cylinder 26 and linkage 27.

The load stabilizer of the present invention, generally designated 30, includes frame means comprised of a generally vertically oriented mounting portion 31 and an upper cantilevered portion 32, from which top clamping means, generally designated 33, is mounted. As best may be seen in FIG. 3, the mounting portion 31 of the frame includes vertically oriented and laterally space apart post housings 34 and 36 into which composite post means 37, in the form of a plurality of telescoped tubes, are mounted. The construction of post means 37 and particularly the plurality of tubular members and the locking sleeves 38 are set forth in detail in my prior U.S. Pat. No. 3,773,202 and will not be repeated herein. Cantilevered frame portion 32 is mounted to the vertical frame portion 31, preferably by a cold rolled member 39, which is L-shaped when viewed in FIG. 1 and U-shaped when viewed in FIG. 3. The ends, which act as vertical posts, of cold rolled bar member 39 are telescoped inside sleeves 38 and post means 37.

Post housings 34 and 36 are held together as a unit by transverse and vertical frame elements 41 (FIG. 3), which are welded to the housings. The post housings are spaced at a distance so that they can be mounted to the ends 42 of transverse members 43 on which forks 24 are mounted. The transverse members 43 in turn are secured to the carriage 23 by bolts or similar fasteners. Thus, the entire vertical frame work 31 can easily be rigidly mounted for vertical reciprocation with carriage 23.

In order to provide for reciprocation of top clamping means 33 with respect to carriage 23 and forks 24, the stabilizer of the present invention further includes a cylinder 44 mounted by shackle 46 or the like to the upper transverse member 43 of the carriage. Piston 47 is mounted by shackle or coupling means 48 to transverse element 49 so that the entire cantilevered portion 32 of the stabilizer can be reciprocated relative to forks 24. The hydraulic cylinder 44 is connected in a conventional manner to the hydraulic system of the lift truck by adding an additional two-way valve.

Thus, the stabilizer of the present invention can be readily attached to a variety of forklift truck configurations by simply welding vertical frame portion 31 to ends 42 of the transverse carriage members 43 and adding a hydraulic control valve to the existing hydraulic unit for powering of cylinder 44.

Figure 2:
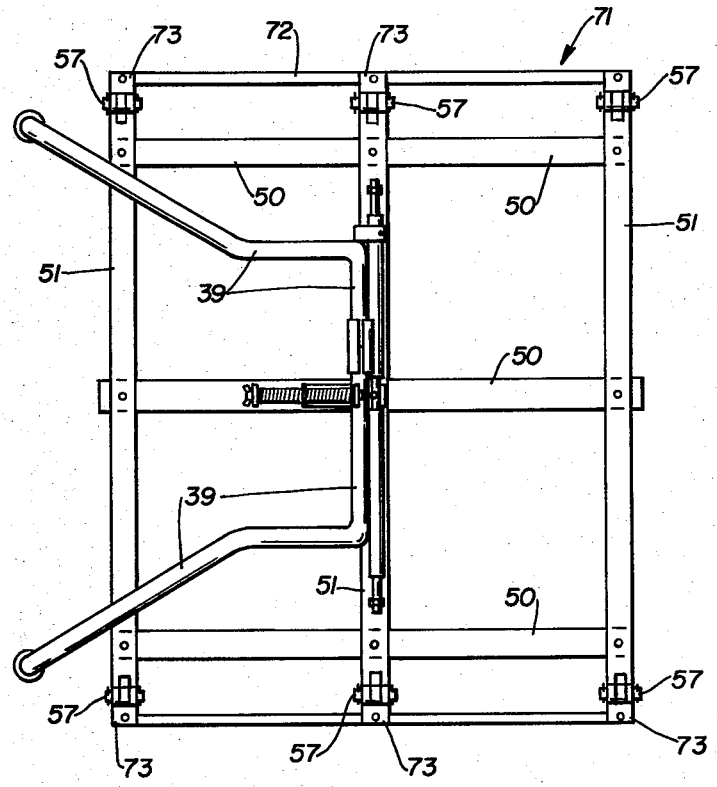
FIG. 2 is a slightly enlarged top plan view of the load stabilizer of FIG. 1.
Figure 4:
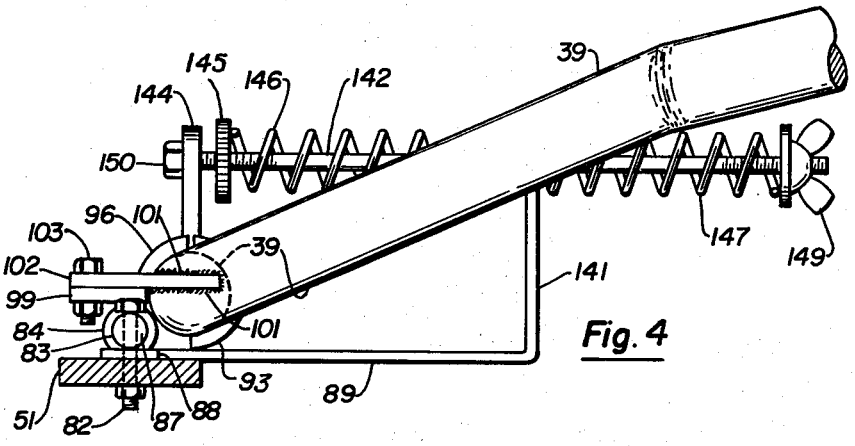
FIG. 4 is an enlarged, fragmentary, end elevational view, partially in cross-section, taken substantially along the plane of line 4—4 of FIG. 3.

In order to provide a clamping force on the top of the load carried for forks 24, top clamping means 33 is downwardly biased to the position shown in FIG. 3 and is mounted for displacement in an upward direction as it engages the load. In the load stabilizer of the present invention, this is preferably accomplished by mounting a horizontally extending generally rectangular frame assembly, composed of longitudinal members 50 and transverse members 51, to cantilevered cold rolled frame member 39 in a manner which will be described in detail hereinafter. From the horizontal assembly of members 50 and 51, three pairs of flat leaf spring members 52 and 53 are pivotally mounted at outer ends 54 to the ends 56 of transverse frame member 51, for example by means of pivot pins 57 (best seen in FIG. 2) passing through looped ends of the leaf springs and frame members 51. The inner ends 58 of the leaf spring members are biased to the vertically spaced position below horizontal frame member 51 shown in FIG. 3 and are displaceable upwardly toward the frame members 50 and 51 against the biasing force.

In the improved load stabilizer of the present invention, biasing of top clamping means 33 downwardly from frame members 50 and 51 is accomplished by a combination of gravity and spring biasing forces. The outer ends of leaf spring members 52 and 53 are pivotally mounted while inner ends 58 are provided with coupling means 59 (FIG. 11) formed to couple the inner ends together and yet permit relative lateral sliding displacement of the inner ends upon upward displacement of the inner ends toward frame element 51. Thus, the pivotal mounting of the outer ends and sliding coupling of the inner ends will cause gravity biasing of member 52 and 53 to the position of FIG. 3 when the stabilizer is lifted by cylinder 44 out of contact with the load.

Figure 11:
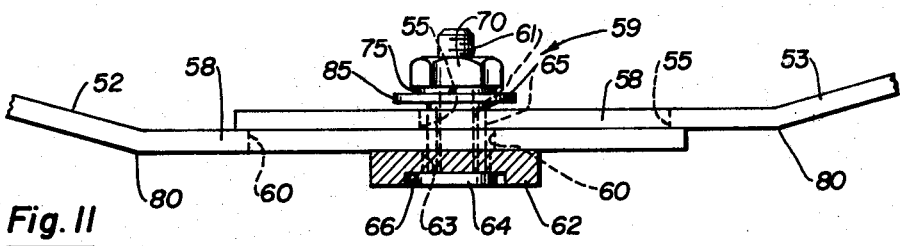
FIG. 11 is a front elevational view, in cross-section, taken substantially along the plane of line 11—11 in FIG. 10.
Figure 10:
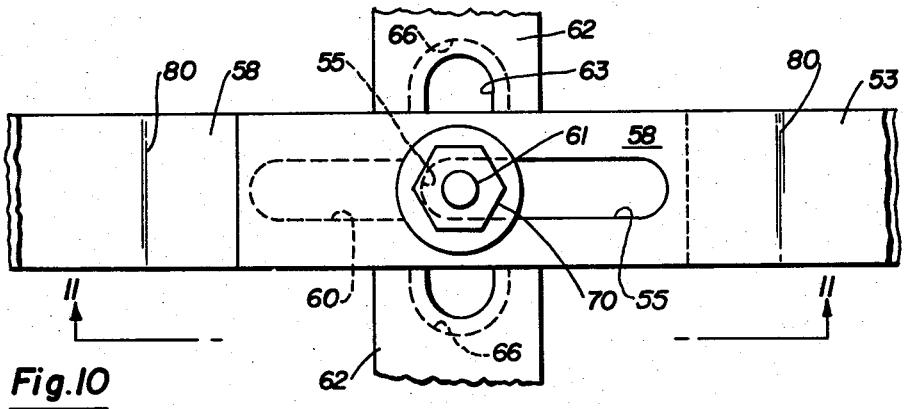
FIG. 10 is an enlarged, fragmentary, top plan view of the top clamping leaf spring elements of the stabilizer of FIG. 1.

The details of coupling of the inner ends 58 of the leaf spring members 52 and 53 may be understood by reference to FIGS. 10 and 11. Each of inner ends 58 be seen to be formed with a transversely extending slot 55 and 60 through which a bolt 61 passes. Slots 55 and 60 are elongated in a transverse direction to permit lateral displacement of the inner ends 58 upon upward displacement of the leaf springs when they engage the top surface of the load. Also coupled together to the ends 58 of the transverse leaf springs is a longitudinally extending spring member 62 formed with a slot 63 through which bolt 61 passes. Longitudinally extending leaf spring 62 is located directly under the middle frame member 50 of FIG. 2. In order to recess the head 64 of bolt 61, it is preferable that leaf spring member 62 be further formed with a recess 66 dimensioned to receive head 64. The leaf spring member 62 connects the three pairs of transverse leaf springs 52 and 53 together for movement as a unit. Thus, member 62 further insures downward gravity biasing of all three pairs of transverse leaf springs, and yet the resiliency of the member 62 accommodates longitudinal variation in the height of the load being clamped. The transverse members 52 and 53, therefore, are to some degree independently vertically displaceable and yet are connected longitudinally for movement as a unit.

In order to insure a sliding coupling of ends 58 and member 62, coupling means 59 further advantageously includes a sleeve 65 having a height greater than the combined thicknesses of ends 58 and member 62 from the bottom of recess 66. Thus, tightening of the nut 70 on bolt 61 against lock washer 75 will not clamp member 52, 53 and 58 together in a manner preventing sliding. As will be appreciated, ends 58 and member 62 can be coupled together for relative sliding displacement in a number of alternative manners.

Additionally, and in order to spring bias the top clamping means to the unclamped position and to spring bias the top clamping means into engagement with the top surface of the load, ends 58 are formed with a bend 80 proximate coupling means 59. As the assembly of leaf springs 52 and 53 is upwardly displaced toward horizontal frame members 50 and 51, the leaf springs 52 and 53 pivot about their outer ends 54 with the inner ends 58 sliding transversely over each other. When the assembly is pressed upwardly to a position proximate the horizontal frame members 51 and 50, the bends 80 cause upward displacement of the ends 58 until they engage the washer 85. Bolt 61 holds the ends of the leaf spring members against further displacement and causes the members 52 and 53 to resiliently flex. Thus, when the stabilizer is lifted up away from the load, the leaf springs 52 and 53 first unbend or unflex, tending to bias the assembly downwardly, and then gravity further biases the assembly leaf spring members to the lowermost position shown in FIG. 3. Although it has not been found necessary, compression springs (not shown) can be mounted between ends 58 and member 51 to further spring bias the members 52 and 53 to the unclamped position of FIG. 3.

The load stabilizer of the present invention also further preferably includes side clamping means, generally designated 71, mounted to the stabilizer for movement to and from a clamped position and an unclamped position upon movement of top clamping means 33 toward the frame. In the improved stabilizer of the present invention, the side clamping means 71 includes a longitudinally extending rail member 72 mounted on a plurality, in this case three, of arms 73 so that the rails 72 can be moved from the unclamped position shown in FIG. 3 to a vertical position at which they will engage the sides of the load to be clamped. This is particularly advantageous when the stabilizer is used as a box clamp designed to stabilize a plurality of small boxes, such as fruit or vegetable boxes, carried by the forklift on a pallet.

Figure 9:
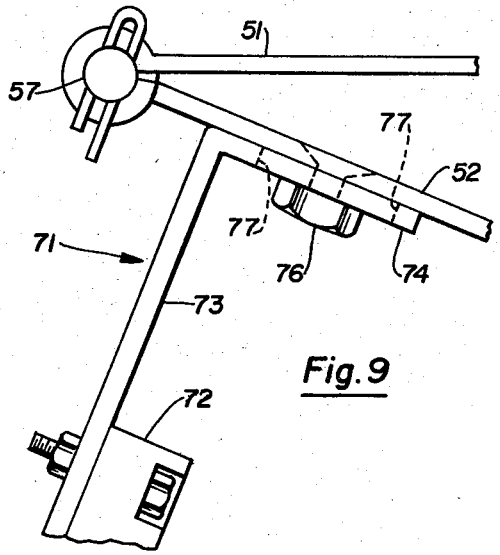
FIG. 9 is an enlarged, fragmentary, front elevational view of the side clamping structure of the stabilizer of FIG. 1.

In order to mount the side clamping means 71 for movement to and from a clamped position automatically with the displacement of the top clamping means, mounting means interconnecting the top clamping means and the side clamping means are provided. The mounting means can be provided by forming arms 73 as L-shaped members having legs 74 which are fastened by bolts or the like 76 to leaf springs 52 and 53. The details of construction can be best seen in FIG. 9. In order to provide for lateral adjustment of the distance between side clamping rails 72, it is further preferable that the leg 74 be slotted at 77 so that the position at which the side clamping means 71 is fixed to the leaf springs 52 and 53 can be adjusted.

As will be apparent from the direct mounting of the side clamping means to the pivotal ends of leaf springs 52 and 53, upward displacement of the leaf spring members of the top clamping means produces a directly proportional angular displacement of the side clamping means from the outwardly inclined unclamped to the vertically disposed clamped position. Moreover, the spring and gravity biasing forces which bias leaf springs 52 and 53 to the downward position of FIG. 3 also bias the side clamping means to the unclamped position.

In the event that the load stabilizer of the present invention is to be used with an unusually wide load, it is possible to simply remove the fastener 76 so that the side clamping means is removable from the top clamping means to accommodate loads of any width. Since there are three arms, this merely requires the unfastening of three bolts on each side to remove the entire arm and rail structure comprising the side clamp. For some loads, it may be necessary only to remove one of these side clamping means, and as is described hereinafter in detail, an alternate embodiment of the side clamping means, in which the side clamping means need not be removed, may be provided.

The load stabilizer of the present invention is further preferably formed for movement of the stabilizer to a stored position while still mounted on the forklift truck so that the forklift can be readily towed. As will be seen from FIG. 1, both forks 24 and load stabilizer 30 extend out from mast 22 a substantial distance. Forks 24 are conventionally formed so that they can be lifted off of the transverse carriage members 43 and placed in the towing vehicle or secured to the body of the forklift truck 21. This leaves the stabilizer 30 extending outwardly from the forklift, which is usually towed by a trailer attachment (not shown) proximate the rear end 25 of the forklift.

Accordingly, it is a further feature of the present invention that forklift load stabilizer 30 be formed for movement to the stored position shown in phantom in FIG. 1. This can be accomplished by forming the stabilizer frame means in a manner which allows the forklift to be pivoted to the stored position. As may be seen in FIG. 3, the post housings 36 and 34 are positioned outwardly of the C-shaped forklift mast members 22. Accordingly, it is possible to form the stabilizer frame in a manner enabling pivoting about one or both of the vertically oriented housings 36 and 34 until the frame is superimposed over the body of the forklift truck. Locking means can be provided for securing the frame in the stored position, as well as in the normally deployed position.

Preferably the cantilever portion 32 of the frame, and particularly cylindrical bar 39, can be split or formed as two separate and independent sections which are joined together by coupling means, generally designated 81. The details of construction of coupling means 81 can best be understood by reference to FIGS. 4 through 7. As will be seen in these FIGS., and particularly FIGS. 5 and 7, the middle transverse frame member 51 is secured by three bolts or fasteners 82 to cylindrical bar 83 mounted for rotation in tubular transversely extending member 84. The ends 86 and 87 of the bar have spacer elements 88 positioned between the cylindrical bar 83 and transverse frame member 51, while at the middle connection, the spring bracket 89, which will be described in more detail hereinafter, acts as a spacer between the cylindrical bar 83 and the transverse member 51. In order to secure the tubular member 84 to cold rolled bar 39, the left side of the tubular member, as viewed in FIG. 3, is welded at 91 to bar 39.

Figure 5:
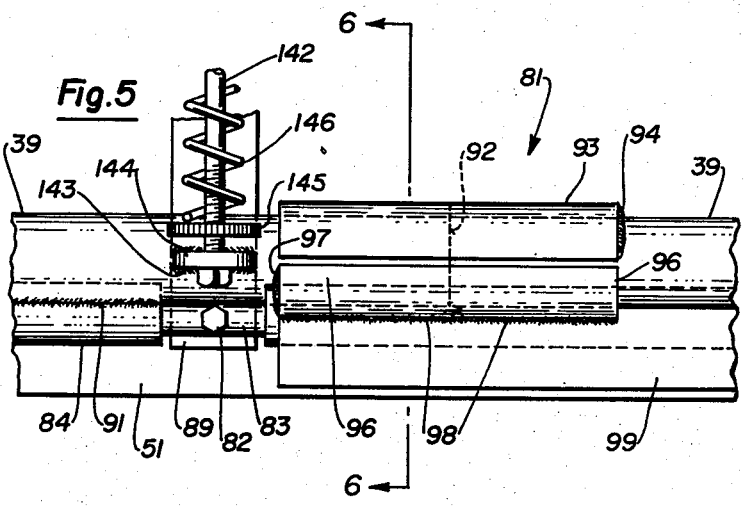
FIG. 5 is an enlarged, fragmentary, top plan view of the area bounded by the line 5—5 in FIG. 3.
Figure 6:
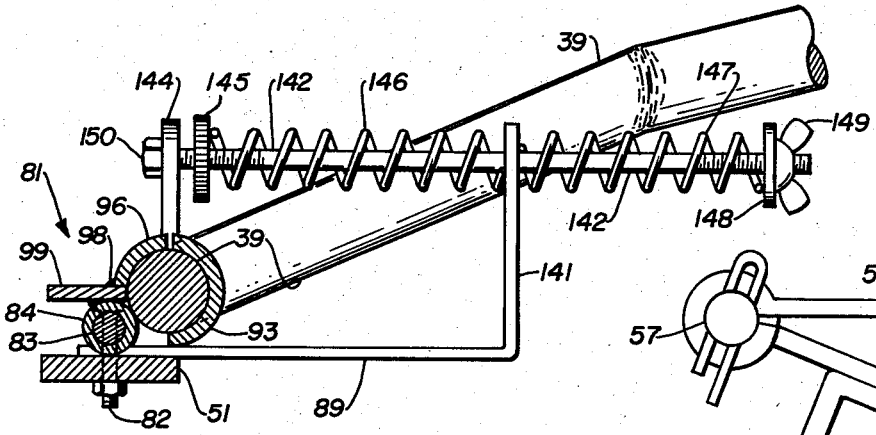
FIG. 6 is a fragmentary, cross-sectional view, taken substantially along the plane of line 6—6 in FIG. 5.

In FIG. 5, the cold rolled bar 39 can be seen to be transversely split or severed at 92 and a longitudinal split sleeve mounted to span across the ends of bar 39. The sleeve includes a rear semicircular portion 93 welded at 94 to the right-hand section of bar 39. In addition, the split sleeve includes a front one-quarter section 96 welded at 97 to the left-hand portion of the bar 39 and welded at 98 to a plate 99, which extends transversely from the center to the right-hand end of cold rolled bar 39. The transverse plate 99 is welded to split sleeve portion 96 and to bar 39 on the left side of the position of severing 92, but plate 99 is not welded to bar 39 on the right-hand side of 92. Welded to the bend in bar 39 by means of weld 101 is an ear or tab 102 which extends over the far right-hand end of plate 99. A bolt 103 passes through ear 102 and plate 99 so as to secure the two together as a unit.

In operation, therefore, one need only remove the bolt 103 in order to disconnect the ear 102, carried by the right-hand side of cold rolled bar 39, from plate 99 and in turn from the remainder of frame member 39. This allows the left-hand side (including plate 99, sleeve portion 96, tubular member 84 and the entire top clamping structure 33) to be pivoted outwardly around the left-hand post housing 36 around mast 22 to a position over the forklift body. The right-hand section of the frame (including the rear split sleeve portion 93 and the ear 102) is now free to be pivoted about housing 34 to a similar stored position over the forklift body.

In order to couple the right and left sections of the stabilizer in the stored position, coupling means, shown in FIG. 8, can be provided. The coupling means includes a flange 106 which is welded at 107 to the vertical portion of bar 39 proximate sleeve 38. The upper portion of sleeve 38 can be provided with a flange 108, with each of the flanges including openings 109 and 111 which will be positioned in registration upon swinging of the load stabilizer sections to the stored position. A pin 112 can be passed through the registered openings to lock the stabilizer in a stored position. The pin may advantageously be connected by a chain or the like 113 to flange 106 so that the pin will not become lost. As will be appreciated, each of the right and left sides of cold rolled bar 39 are provided with a flange which can be pinned to sleeve 38.

Figure 13:
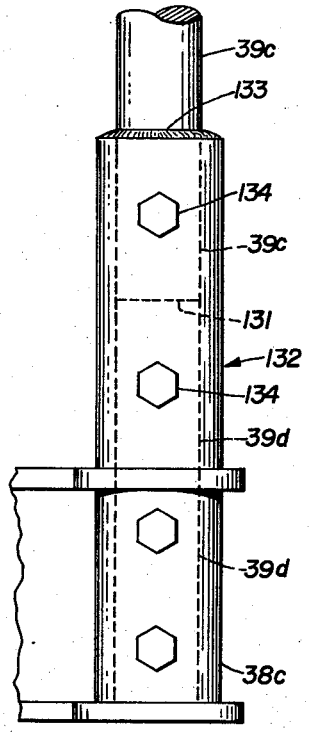
FIG. 13 is an enlarged, fragmentary, side elevational view of still a further alternative structure for a split vertical post for the stabilizer of FIG. 1.

Alternative embodiments of frame means which are constructed so that the stabilizer may be pivoted to a stored position are shown in FIGS. 12 and 13. In FIG. 12, the vertical portion of the tubular member 39 is divided into a lower section 39*a*, telescopically received in sleeve 38*a*, and an upper portion 39*b*, which extends upwardly and then outwardly in a cantilevered manner as described above in connection with bar 39. The upper and lower sections each have flanges 121 and 122 welded thereto at 123 and 124. A plurality of bolts 126 are employed to secure the flanges together as a unit. In the form of the stabilizer shown in FIG. 12, therefore, one of the two vertical sections of the cold rolled bar is severed proximate sleeve 38*a* and provided with a flange coupling as shown. In order to swing the load stabilizer to a stored position, one need only remove bolts 126, and the entire stabilizer, including the upper bar section 39*a*, will be pivoted about the opposite post housing to the stored position, leaving only the lower bar section or post 39*a* supported on sleeve 38*a*.

In FIG. 13, a similar structure is shown wherein upper bar section 39*c* terminates or is split at end 131, superimposed over lower bar or post section 39*d*. A vertically split sleeve, generally designated 132, spans across the end 131 between the upper and lower bar sections and has a front semicircular sleeve which is welded at 133 to upper bar section 39*c*, with the rear half of the vertically split sleeve being welded to the lower bar section. Transverse bolt fasteners 134 are used to couple the sleeve halves and bar sections 39*c* and 39*d* together as a unit. In operation, therefore, one need only remove both the fasteners 134 and swing the upper bar section 39*c*, together with half of the split sleeve and all of the stabilizing unit, about the opposite post housing to a stored position. The other half of the split sleeve and lower bar or post section 39*d* merely remain in place on top of sleeve 39*c*.

In each of the embodiments of FIGS. 12 and 13, a means for locking the stabilizer in the stored position can be provided on the opposite post, for example, by use of the structure of FIG. 8.

As was noted hereinabove, it is preferable for the horizontal assembly of frame members 50 and 51 to be pivotally mounted to the transverse portion of bar 39. It is a further feature of the present invention that the stabilizer be formed with spring biasing means which is formed to hold the assembly of horizontal frame members 51 and 50 in a generally horizontal orientation. Thus, spring bracket 89 is mounted, by bolt 82, to the transverse horizontal member 51. Bracket 89 is L-shaped and has an upper leg portion 141 with an opening therethrough for receipt of spring mounting bolt 142. Secured to the top of bar 39, for example by welding at 143, is an ear or second mounting bracket 144. Bracket 144 is similarly formed with an opening to receive bolt 142. Mounted coaxially with bolt 142 are a pair of springs 146 and 147, and the end of spring bolt 142 is provided with spring alignment means 148 and wing nut 149 enabling adjustment of the spring force in spring 147. The spring alignment merely holds the end of spring 147 is generally centered relation to bolt 142.

Also threadably mounted proximate head 150 of bolt 142 is a manually engageable spring tension adjustment membr 145, which enables adjustment of the spring tension in spring 146.

In operation, tilting of the assembly forming the top clamping means causes rotation of bar 83 and central member 51, which in turn will rotate bracket 89 about tubular member 84. As the bracket rotates, the end 141 of the bracket will compress one of springs 146 and 147 biasing the assembly back to the horizontal position. The tilting feature of the present invention enables the stabilizer to conform to loads which have a tilted top surface.

Figure 14:
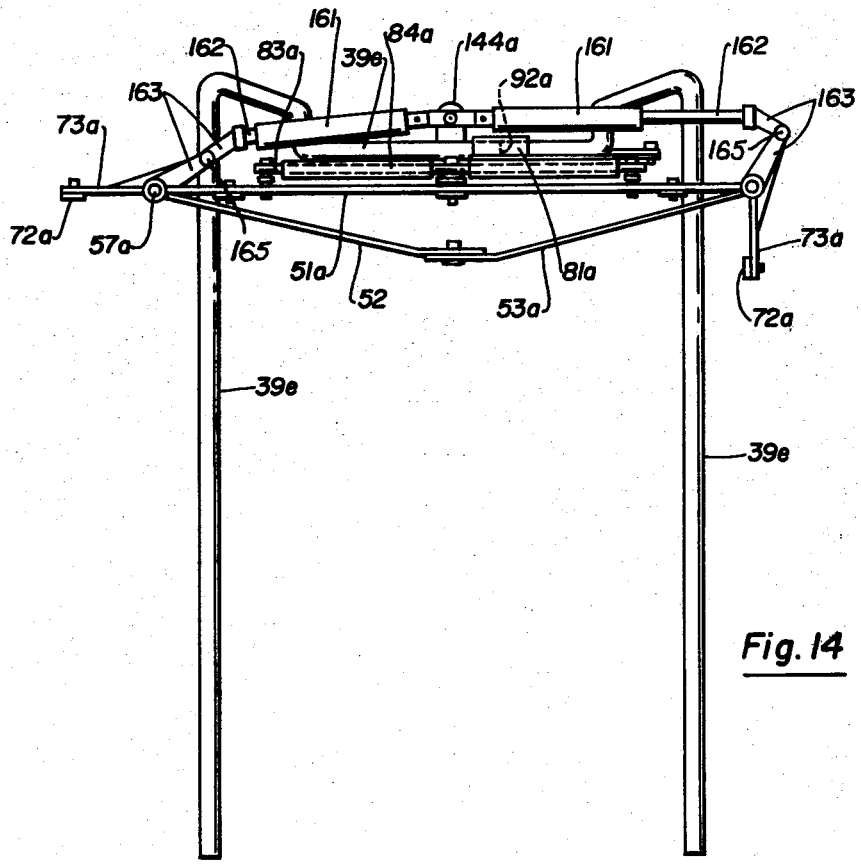
FIG. 14 is a front elevational view of an alternative embodiment of the stabilizer constructed in accordance with the present invention.

Referring now to FIG. 14, still a further alternative embodiment of the forklift stabilizer of the present invention is show. The load stabilizer includes a cold rolled bar **39*e* which is split at 92*a* and joined together by coupling means 81*a*. The central transverse frame member 51*a* is bolted to bar 83*a*, which in turn is mounted in tubular member 84*a* welded to bar member 39*e*. Instead of mounting side clamping arms 73*a* directly for movement with leaf spring elements 52*a* and 53*a*, the arms 73*a*** are mounted for independent movement to and from a clamped and unclamped position.

Mounted to bracket **144*a* are a pair of hydraulic cylinders 161 which are connected to the hydraulic system of the lift truck through an auxiliary valve for independent operation. Pistons 162 extend outwardly of the cylinder and are connected by linkages 163, including pivot 165, to pivotally mounted arms 73*a*. The arms are pivoted for rotation about pins 57*a*, but the pivotal motion is independent of pivoting of the leaf spring elements. Thus, when the piston is extended as is shown on the right side of FIG. 14, the arms 73*a* move to a vertical position so that rails 72*a* will engage and clamp the side of the load. The linkage 163, however, is also formed so that when the piston 162 is in the retracted position, shown on the left side of FIG. 14, the arms 73*a* are in a horizontal position so that the rails 72*a* will engage the top of the load. This enables the clamping device to be used to clamp down on the top of loads of extreme width and yet enables the same device to be used to clamp on the sides of narrower loads to provide additional stabilization. In the form of the invention shown in FIG. 14, only the central arms 73*a* are connected to hydraulic cylinders 161, but the longitudinally extending rails 72*a* cause the end pairs of arms to move together with the central arms. Although shown in FIG. 14 with one of the arms 73*a* in a horizontal position and the other in a vertical position, normally the cylinders 161** will be driven together so that both arms are either horizontal or vertical.

What is claimed is:

1. A load stabilizer for use with a forklift truck and including frame means, and top clamping means mounted to said frame means for displacement in an upward direction upon engagement with a load carried by said truck, said top clamping means being formed and being mounted to said frame means for biasing in a downward direction, wherein the improvement in said stabilizer is comprised of:

said top clamping means includes at least one leaf spring member mounted to said frame means for biasing in a downward direction under a combination of gravity and spring biasing forces, said leaf spring member being mounted to said frame means for upward displacement from its lowermost position initially solely against a gravity biasing force and thereafter for upward displacement against resilient bending of said leaf spring.

2. A load stabilizer for use with a forklift truck and including frame means, and top clamping means mounted to said frame means for displacement in an upward direction upon engagement with a load carried by said truck, said top clamping means being formed and being mounted to said frame means for biasing of said top clamping means in a downward direction, wherein the improvement in said stabilizer is comprised of:

said top clamping means includes at least one pair of resilient members pivotally mounted at outer ends thereof to said frame means and joined to each other by coupling means proximate inner ends thereof, said inner ends being normally biased to a vertically spaced distance below said frame means and being displaceable toward said frame means, said coupling means being formed for relative lateral displacement of said inner ends of said members upon upward displacement of said inner ends toward said frame means.

3. The stabilizer as defined in claim 2 wherein, said resilient members are formed as flat leaf spring members, and said coupling means is provided by slots in said inner ends of said leaf spring members and a connecting fastener passing through said slots and coupling said inner ends together.

4. The stabilizer as defined in claim 3 wherein, said leaf spring members are formed with a bend proximate said inner ends formed to induce resilient bending of said leaf spring members.

5. A load stabilizer for use with a forklift truck and including frame means, top clamping means mounted to said frame means for displacement in an upward direction upon engagement with a load carried by said truck, said top clamping means being formed and being mounted to said frame means for biasing of said top clamping means in a downward direction, and side clamping means mounted to said stabilizer for movement to and from a clamped and an unclamped position upon displacement of said top clamping means, wherein the improvement in said stabilizer is comprised of:

said top clamping means being pivotally mounted to said frame means for upward displacement of a portion thereof, and said side clamping means being mounted directly to said top clamping means for pivotal motion therewith to effect displacement to and from said clamped and unclamped positions.

6. A load stabilizer as defined in claim 5 wherein, said side clamp means are removably mounted to each side of one of said top clamping means and said frame means, said side clamp means being formed for selective lateral adjustment of the distance therebetween.

7. A load stabilizer is defined in claim 1, and side clamping means movably mounted to each side of one of said top clamping means and said frame means, and hydraulic drive means connected to said side clamping means and formed for selective displacement of said side clamping means to and from a clamped and an unclamped position independently of displacement of said top clamping means.

8. A load stabilizer as defined in claim 7, wherein, said hydraulic drive means is connected and said side clamping means is formed for movement of said side clamping means to a position enabling top clamping of loads of a width greater than said stabilizer.

9. A load stabilizer for use with a forklift truck having a vertically extending mast with load carrying forks movably mounted thereto, said stabilizer including a frame means having a mounting portion formed for mounting to said truck and a cantilevered portion extending outwardly from said mounting portion in superimposed relation to said forks, and load clamping means mounted to said cantilevered portion and formed for engagement with and clamping of a load carried by said forks, wherein the improvement in said stabilizer is comprised of:

said mounting portion being mounted to said truck for pivotal movement about a generally vertically oriented axis to and from a deployed position with said clamping means superimposed over said forks and a stored position with said clamping means superimposed over said truck, said mounting portion being further mounted to said truck and formed for pivotal movement from said deployed position and to said stored position by swinging laterally around the outside of said vertically extending mast at a height below the top of said vertically extending mast to enable compact, and safe storage of said clamping means, and means for locking said mounting portion in said deployed position and said stored position.

10. A load stabilizer as defined in claim 9 wherein, said mounting portion includes two laterally spaced apart vertically oriented post housing having vertically oriented posts mounted for pivotal movement about a vertical axis therein, said post housing being positioned laterally outside of the sides of said vertically extending mast, said cantilevered portion extends between and outwardly from said posts and is formed as two separable and independent cantilevered sections, and coupling means intermediate said posts and formed for selective coupling of said cantilevered sections together as a unit and formed for uncoupling of said cantilevered sections for independent rotation of said posts and said cantilevered sections around the sides of said vertically extending mast at a height below the top of said vertically extending mast to said stored position.

11. A load stabilizer as defined in claim 9 wherein, said mounting portion includes two laterally spaced apart vertically oriented post housing positioned outside the sides of said vertically extending mast and having vertically oriented posts mounted therein for pivotal movement about a vertical axis, at least one of said posts being formed with two independent and separable post sections, said means for locking said load clamping means in said deployed position is provided as coupling means formed for and mounted to enable selective coupling and uncoupling of said post sections.

* * * * *